US006325165B1

(12) United States Patent
Eyre

(10) Patent No.: US 6,325,165 B1
(45) Date of Patent: Dec. 4, 2001

(54) CUTTING ELEMENT WITH IMPROVED POLYCRYSTALLINE MATERIAL TOUGHNESS

(75) Inventor: Ronald K. Eyre, Orem, UT (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/573,142

(22) Filed: May 17, 2000

Related U.S. Application Data

(62) Division of application No. 09/036,577, filed on Mar. 6, 1998, now abandoned.

(51) Int. Cl.[7] ..... E21B 10/36

(52) U.S. Cl. ..... 175/426; 175/431; 451/542; 51/293

(58) Field of Search ..... 17/426, 425, 428, 17/430, 431, 432, 434; 451/540, 541, 542, 41; 51/293, 295, 297, 307, 309; 407/118, 119; 76/108.1, 108.6

(56) References Cited

U.S. PATENT DOCUMENTS

| | | | | |
|---|---|---|---|---|
| 4,255,165 | | 3/1981 | Dennis et al. | 51/309 |
| 4,592,433 | | 6/1986 | Dennis | 175/329 |
| 4,866,885 | | 9/1989 | Dodsworth | 51/293 |
| 4,984,642 | | 1/1991 | Renard et al. | 175/329 |
| 5,007,207 | * | 4/1991 | Phaal | 51/295 X |
| 5,135,061 | | 8/1992 | Newton, Jr. | 175/428 |
| 5,217,081 | | 6/1993 | Waldenström et al. | 175/420.2 |
| 5,273,379 | * | 12/1993 | Nishimura | 76/108.6 X |
| 5,297,456 | * | 3/1994 | Nishimura | 76/108.6 |
| 5,355,969 | * | 10/1994 | Hardy et al. | 175/432 |
| 5,379,854 | * | 1/1995 | Dennis | 175/434 |
| 5,492,188 | | 2/1996 | Smith et al. | 175/432 |
| 5,527,215 | * | 6/1996 | Rubino et al. | 451/527 |
| 5,544,713 | * | 8/1996 | Dennis | 175/434 |
| 5,590,728 | * | 1/1997 | Matthias et al. | 175/432 |
| 5,611,649 | * | 3/1997 | Matthias | 175/428 X |
| 5,617,928 | * | 4/1997 | Matthias et al. | 175/432 |
| 5,630,479 | * | 5/1997 | Dennis | 175/426 |
| 5,690,540 | * | 11/1997 | Elliott et al. | 451/41 |
| 5,766,394 | * | 6/1998 | Anderson et al. | 51/297 X |
| 5,868,885 | * | 2/1999 | Crockett et al. | 51/297 |
| 5,944,583 | * | 8/1999 | Cruz et al. | 451/41 |
| 5,984,769 | * | 11/1999 | Bennett et al. | 451/527 |
| 6,025,076 | * | 2/2000 | Collins | 51/307 X |
| 6,135,865 | * | 10/2000 | Beardsley et al. | 451/285 |
| 6,148,937 | * | 11/2000 | Mensa-Wilmot et al. | 175/428 |
| 6,149,695 | * | 11/2000 | Adia et al. | 51/307 |

FOREIGN PATENT DOCUMENTS

| | | | | |
|---|---|---|---|---|
| 0462955-A1 | * | 6/1991 | (EP) | 175/426 |
| 0582484 | * | 8/1993 | (EP) | 175/426 |
| 2 261 894 A | | 6/1993 | (GB) . | |
| 2 279 677A | | 1/1995 | (GB) . | |

* cited by examiner

*Primary Examiner*—David Bagnell
*Assistant Examiner*—Jong-Suk Lee
(74) *Attorney, Agent, or Firm*—Christie, Parker & Hale, LLP

(57) ABSTRACT

A cutting element having a cutting table made from sheet segments of commingled ultra hard material and binder. Each segment may be made from a finer or a coarser grade of ultra hard material or from different types of ultra hard material. The segments are aligned side by side over a cutting face of the cutting element to form the cutting table. The material grade and/or the material type of each segment may alternate across the cutting face.

11 Claims, 3 Drawing Sheets

CUTTING ELEMENT WITH IMPROVED POLYCRYSTALLINE MATERIAL TOUGHNESS

This patent application is a divisional application of U.S. patent application Ser. No. 09/036/577, filed Mar. 6, 1998, now abandoned.

BACKGROUND OF THE INVENTION

This invention relates to cutting elements for use in a rock bit and more specifically to cutting elements which have a cutting table made up of segments of an ultra hard material.

A cutting element, such as a shear cutter shown in FIG. 1, typically has a cylindrical tungsten carbide substrate body 10 which has a cutting face 12. An ultra hard material cutting table 14 (i.e., layer) is bonded onto the substrate by a sintering process. The ultra hard material layer is typically a polycrystalline diamond or polycrystalline cubic boron nitride layer. During drilling, cracks form on the polycrystalline ultra hard material layer. These cracks are typically perpendicular to the earth formation being drilled. These cracks grow across the entire ultra hard material layer causing the failure of the layer and thus of the cutter. Growth of these cracks result in chipping, laminar type spalling and exfoliation. As such, there is a need for a cutting element having a cutting table that is capable of resisting crack growth.

SUMMARY OF THE INVENTION

The present invention is directed to a cutting element having a cutting table which is formed from segments of an ultra hard material. Preferably, some of the segments are made from finer grade of ultra hard material while the remaining segments are made from a coarser grade of ultra hard material. The segments alternate from a finer grade to a coarser grade across the cutting face of the cutting element. It is preferred that the finer grade material makes contact with the earth formation. As such, preferably, a finer grade segment makes up the edge of the cutting table making contact with the earth formation.

In an alternate embodiment, some of the segments are made from a first type of ultra hard material such a diamond, while the remainder of the segments are made from a second type of ultra hard material such as cubic boron nitride. With this embodiment, the segments form the cutting table and alternate from the first type of ultra hard material to the second type across the cutting table.

It is preferred that the segments are high shear compaction sheet segments which are formed by slitting a high shear compaction sheet. The segments forming the cutting table can be linear and parallel to each other. They may be concentric ring-shaped strips or spiraling strips Moreover, two sets of strips may be employed to form the cutting table wherein the strips within each set are parallel to each other and wherein the first set is angled relative to the second set of strips.

DETAILED DESCRIPTION OF THE INVENTION

Figure 1:
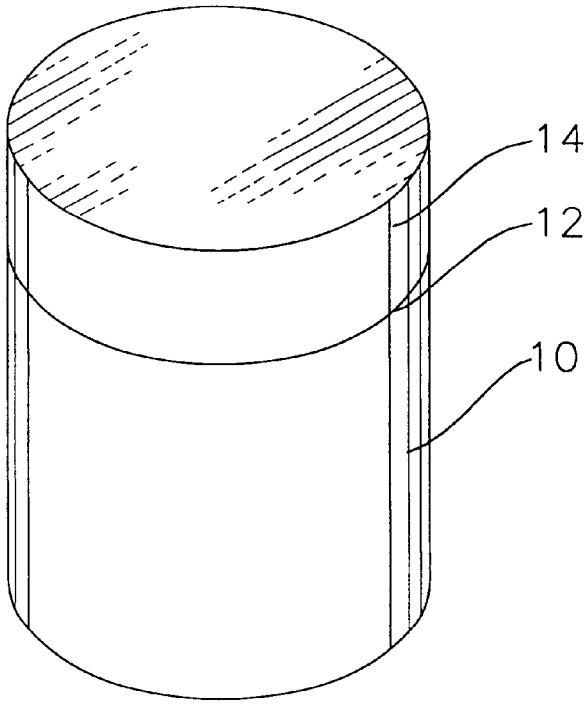
FIG. 1 is a perspective view of a typical shear cutter.

This invention relates to cutting elements having cutting tables with enhanced toughness and to a method of making such cutting elements. Cutting elements employed in rock bits that have a variety of conventional shapes. For descriptive purposes, the present invention is described in relation to a cylindrical cutting element. A cylindrical cutting element such as a shear cutter as shown in FIG. 1 has a cylindrical cemented tungsten carbide body 10 which has a cutting face 12. An ultra hard material layer 14 is bonded onto the cutting face and forms the cutting table. The ultra hard material layer is typically either a polycrystalline diamond (PCD) layer or a polycrystalline cubic boron nitride (PCBN) layer.

To enhance the toughness of the cutting table two or more dissimilar grades of the ultra hard material are alternated along the cutting face of the cutter. A finer grade ultra hard material has higher abrasion resistance. A courser grade ultra hard material is known to be tougher.

Due to the nature of drilling, cracks form on the polycrystalline ultra hard material which are typically almost perpendicular to the earth formation being drilled. These cracks generally result in chipping, laminar type spalling and exfoliation. The present invention provides a way of arresting crack growth before it propagates across the entire cutting table thereby prolonging the life of the cutting element.

The polycrystalline ultra hard material cutting table of the present invention is formed on the cutting face of the cutting element such that grade alternates from a finer grade to a coarser grade in a direction perpendicular to the formation. Preferably a finer grade would be used to do the cutting (i.e.. will be in contact with the earth formation) while the coarser grade would be used to arrest any crack grown. As such, a finer grade would preferably be located at the edge of the cutting table which would contact the earth formation. Typically, what would happen is that a crack will form proximate the edge and would start traveling perpendicular to the formation. Once the crack reaches the coarser material, crack growth would be arrested. As a result, the toughness of the polycrystalline cutting table is increased.

Figure 2:
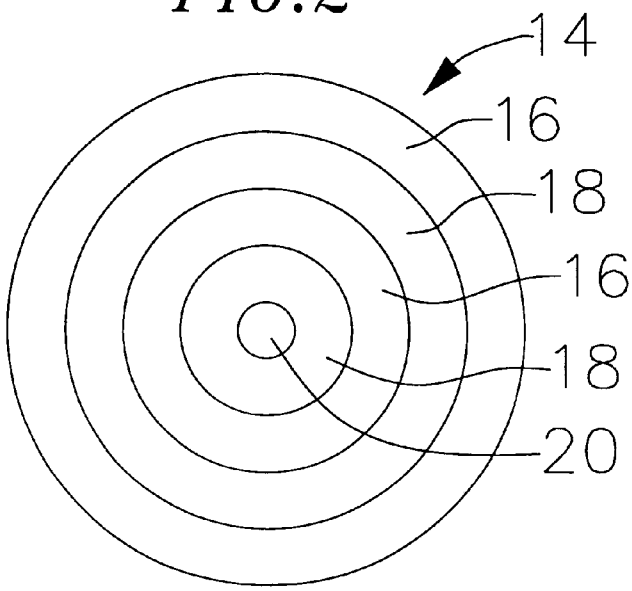
FIG. 2 is a top view of a cutting element prior to sintering having a cutting table made of concentric ring-shaped ultra hard material strips.

In a first embodiment shown in FIG. 2, the ultra hard material cutting table 14 is formed by placing ring-shaped concentric spaced apart segments 16 of a single ultra hard material grade over the cutting face of a presintered tungsten carbide substrate body. The spaces between the concentric rings are then fitted with a second set of concentric ring-shaped segments 18 made from a different grade of material.

Once the segments are sintered, they from a polycrystalline ultra hard material table which alternates in grade cross the cutting face. Preferably, the set of concentric segments which include the concentric segment forming the edge of the cutting table 14 are the finer grade segments. As it would become apparent to one skilled in the art, the centermost segment 20 will be circular and not ring-shaped.

Figure 3:
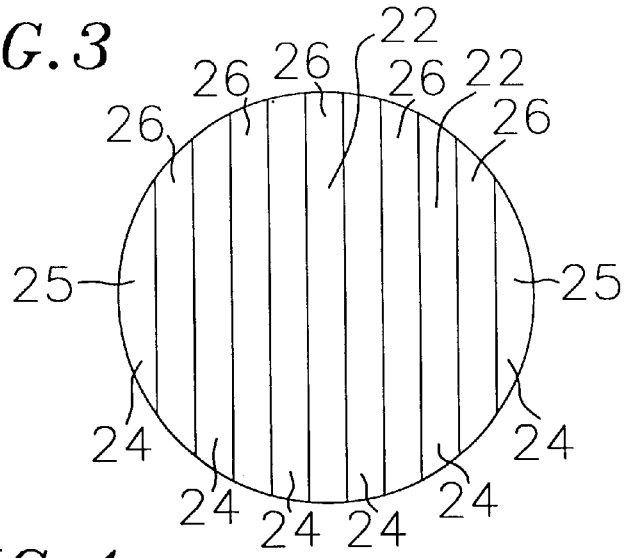
FIG. 3 is a top view of a cutting element prior to sintering having a cutting table made from linear parallel chordwise ultra hard material strips.

In a further embodiment as shown in FIG. 3, chordwise segments (i.e., strips) 22 of the ultra hard material are placed on top of the substrate cutting face and form the cutting element cutting table. These strips may be of a single grade or may be of multiple grades of ultra hard material. Preferably, two sets of strips are employed. The first set 24 is made from a finer grade of ultra hard material, while the second set 26 is made from a coarser grade of ultra hard material. Strips from the first set are alternated in parallel with strips from the second set along the cutting element body cutting face. Strips from the first set, preferably make up the edges of the cutting table that will contact the earth formation. As it would become apparent to one skilled in the art, one side of each of the edge strips 25 is curved so as to be aligned with the cutting element body.

Figure 4:
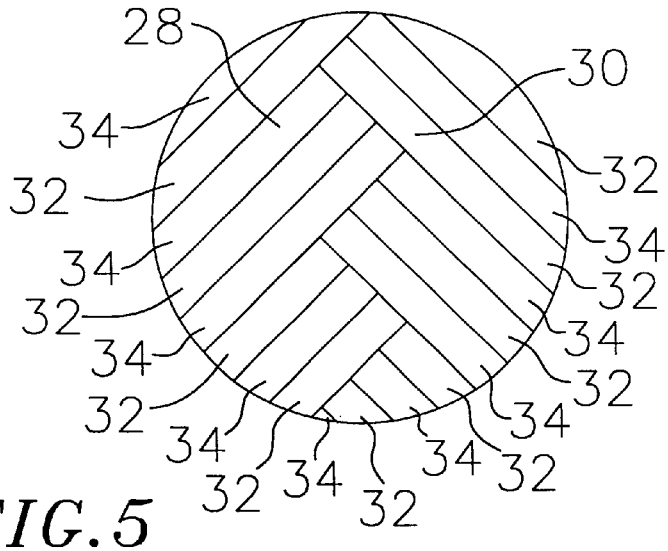
FIG. 4 is a top view of a cutting element prior to sintering having a cutting table made of two sets of parallel ultra hard material strips, wherein the first set is angled relative to the second set.

In yet a further embodiment shown in FIG. 4, two sets of strips 28, 30 are used. The strips of the first set are positioned on the cutting element cutting face at an angle to the strips of the second set. The strips may be of a single grade or multiple grades of ultra hard material. Preferably, two grades 32, 34 are used wherein strips within each set alternate from strip of a finer grade to a strip of a coarser grade of ultra hard material.

To maximize the life of the cutting elements of the embodiments which have a cutting table formed from chordwise strip segments of ultra hard material, it is preferred that such cutting elements are mounted on the rock bit bodies so as to contact the earth formations at an angle perpendicular to the ultra hard material strips.

Figure 5:
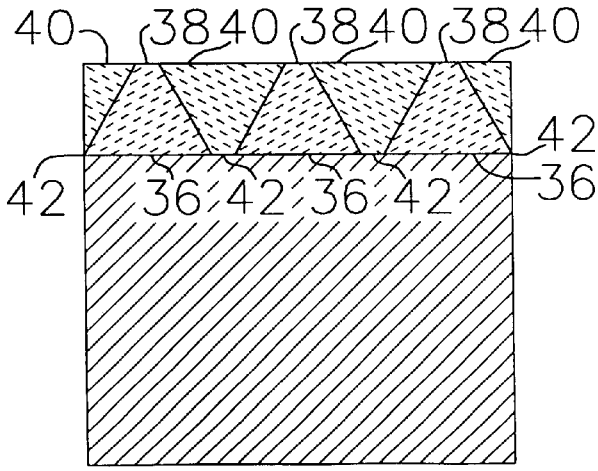
FIG. 5 is cross-sectional view of a cutting element prior to sintering having a cutting table made of two sets of mated strips wherein the strips are tapered in cross-section such that the strips of the first set are wider at the bottom and narrower at the top and the strips of the mated second set are wider at the top and narrower at the bottom.

With any of the above embodiments, the segments may have cross-sections as shown in FIG. 5. For example, a set of spaced-apart segments may have a wider bottom 36 and a narrower top 38 in cross-section, while a second set of spaced-apart segments which is inter-fitted with the first set may have a wider top 40 and a narrower bottom 42 such that the second set is complementary to the first set as shown in FIG. 5.

With any of the above described embodiments, more than two different grade ultra hard material segments may be used. In such cases, it is preferred that the segments alternate from a first, to a second, to a third grade and so forth across the cutting table. In yet further embodiments, all of the ultra hard material segments employed in any of the above described embodiments may be formed from a single grade of ultra hard material. With these embodiments, the bond line between the successive segments would serve to divert and arrest crack growth. In yet further embodiments, instead of alternating segments of different grades of ultra hard material across the table, segments of different types of ultra hard materials are alternated across the cutting table. For example, diamond segments may be alternated with cubic boron nitride segments. These segments may contain ultra hard material of the same or different grades.

By being able to vary the material characteristics of the cutting layer across its face, the compressive residual stresses formed across the ultra hard material layer can be controlled or tailored for the task at hand. In other words, the residual compressive stress distribution on the ultra hard material layer can be engineered. For example, in the embodiment shown in FIG. 2, each ultra hard material ring-shaped segment may be made from a coarser material than the segment immediately radially outward from it. Since a coarser grade material shrinks less than a finer grade material during sintering, each segment will impose a compressive hoop stress on its immediately inward segment. As a result, a cutting layer will be formed having compressive hoop stresses.

With all of the aforementioned embodiments, it is preferred that the segments are cut from an ultra hard material tape, i.e., they are segments of the ultra hard material tape. Preferably, they are cut from a high shear compaction sheet of commingled ultra hard material and binder. Typically, such a high shear compaction sheet is composed of particles of ultra hard materials such as diamond or cubic boron nitride, and organic binders such a polypropylene carbonate and possibly residual solvent such as methyl ethyl ketone (MEK). The sheet of high shear compaction material is prepared in a multiple roller process. For example, a first rolling in a multiple roller high shear compaction process produces a sheet approximately 0.25 mm thick. This sheet is then lapped over itself and rolled for a second time, producing a sheet of about 0.45 mm in thickness. The sheet may be either folded or cut and stacked in multiple layer thickness.

This compaction process produces a high shear in the tape and results in extensive mastication of ultra hard particles, breaking off comers and edges but not cleaving them and creating a volume of relatively smaller particles in situ. This process also results in thorough mixing of the particles, which produces a uniform distribution of the larger and smaller particles throughout the high shear compaction material. The breakage rounds the particles without cleaving substantial numbers of the particles.

Also, high shear during the rolling process produces a sheet of high density, i.e., about 2.5 to 2.7 g/cm$^3$, and preferably about 2.6±0.05 g/cm$^3$. This density is characteristic of a sheet having about 80 percent by weight diamond crystals (or cubic boron nitride crystals), and 20 percent organic binder. At times, it is desirable to include tungsten carbide particles and/or cobalt in the sheet. There may also be times when a higher proportion of binder and lower proportion of diamond or cubic boron nitride particles may be present in the sheet for enhanced "drapability." The desired density of the sheet can be adjusted proportionately and an equivalent sheet produced.

The sheet of high shear compaction material is characterized by a high green density, resulting in low shrinkage during firing. For example, sheets used on substrates with planar surfaces have densities of about 70 percent of theoretical density. The high density of the sheet and the uniform distribution of particles produced by the rolling process tend to result in less shrinkage during the presinter heating step and presintered ultra hard layers with very uniform particle distribution, which improves the results obtained from the high pressure, high temperature process.

Figure 6:
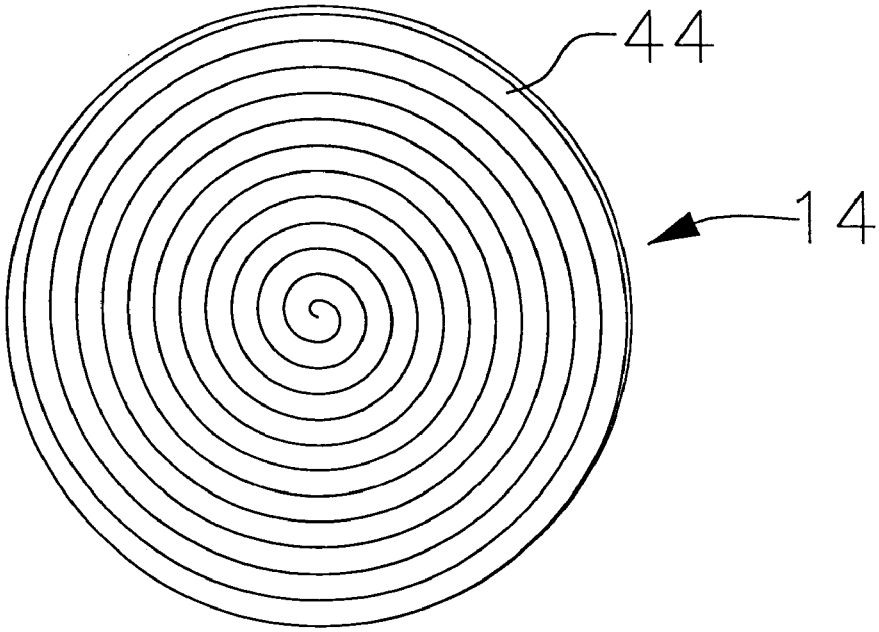
FIG. 6 is a top view of a cutting element prior to sintering having a cutting table formed from a spiraling ultra hard material strip.

In yet a further alternate embodiment shown in FIG. 6, a spiraling strip 44 forms the cutting table 14. To form the spiraling strip, preferably an ultra hard material high shear compaction sheet is rolled into a roll. A slice is cut off the end of the roll. The slice which is in the form of a spiraling strip is then bonded to the cutting element body cutting face forming the cutting table.

Figure 7:
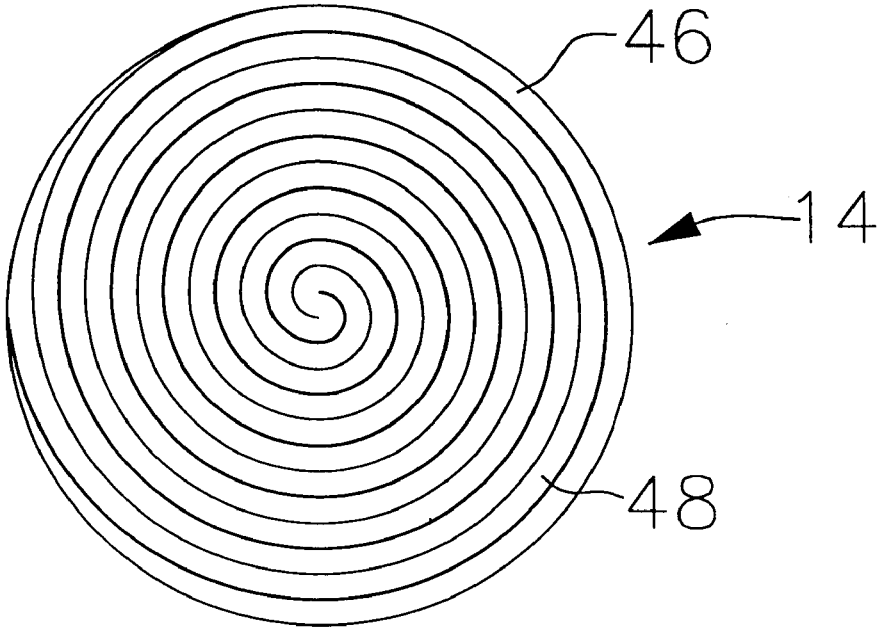
FIG. 7 is a top view of a cutting element prior to sintering having a cutting table formed from two spiraling strips of ultra hard material.

In another embodiment shown in FIG. 7, the cutting table 14 is formed from two spiraling strips 46, 48 of an ultra hard material. It is preferred that each of the strips is made from a different grade of the ultra hard material. Alternatively, each strip may be made from a different type of ultra hard such as diamond and cubic boron nitride To form the cutting table, preferably a first ultra hard material high shear compaction sheet 48 is placed over a second ultra hard material high shear compaction sheet 46. The two sheets are rolled forming a roll. An end of the roll is sliced off. The sliced portion which is made up of two spiraling strips is bonded to the cutting face of the cutting element body to form the cutting table.

What is claimed is:

1. A cutting element comprising:

a body having a cutting face; and a cutting table formed over the cutting face by a spiraling ultra hard material strip, comprising a first side opposite a second side, wherein the first side abuts the second side.

2. A cutting element as recited in claim 1 wherein the strip is cut from a high shear compaction sheet of commingled ultra hard material and binder.

3. A cutting element comprising:

a body having a cutting face;

a cutting table formed over the cutting face by two spiraling strips of ultra hard material wherein said strips abut each other.

4. A cutting element as recited in claim 3 wherein the two strips are made from different grades of ultra hard material.

5. A cutting element as recited in claim 3 wherein the two strips are made from different types of ultra hard material.

6. A cutting element as recited in claim 3 wherein at least one of said strips is formed from a high shear compaction sheet of commingled ultra hard material and binder.

7. A cutting element as recited in claim 3 wherein one of said strips is made from a first grade of ultra hard material and the other of said strips is made from a second grade of a ultra hard material wherein the first grade of ultra hard material is different from the second grade of ultra hard material.

8. A cutting element as recited in claim 3 wherein one of said strips is made from a first type of ultra hard material and the other of said strips is made from a second type of a ultra hard material wherein the first type of ultra hard material is different from the second type of ultra hard material.

9. A cutting element as recited in claim 8 wherein said strip comprises diamond and said other strip comprises cubic boron nitride.

10. A cutting element comprising:

a body having a cutting face;

a cutting table formed over the cutting face by a plurality of spiraling strips of ultra hard material, wherein each of said strips abuts another of said strips.

11. A cutting element as recited in claim 10 wherein the abutting strips define a surface of the cutting table opposite the cutting face that is continuous along a diameter of the cutting table.

* * * * *